United States Patent [19]

Stoll

[11] Patent Number: 4,736,674

[45] Date of Patent: Apr. 12, 1988

[54] ABUTMENT ARRANGEMENT AND POSITION DETECTOR FOR A PISTON AND CYLINDER ACTUATOR

[76] Inventor: Kurt Stoll, Lenzhalde 72, 7300 Esslingen, Fed. Rep. of Germany

[21] Appl. No.: 810,647

[22] Filed: Dec. 18, 1985

[30] Foreign Application Priority Data

Dec. 22, 1984 [DE] Fed. Rep. of Germany ..... 3447221
Jan. 26, 1985 [DE] Fed. Rep. of Germany ..... 3502615
Jul. 13, 1985 [DE] Fed. Rep. of Germany ..... 3525029

[51] Int. Cl.[4] ..... F01B 25/26; F01B 31/12

[52] U.S. Cl. ..... 92/5 R; 92/13.5; 92/13.8

[58] Field of Search ..... 92/5 R, 13, 13.4, 13.5, 92/13.8; 91/1

[56] References Cited

U.S. PATENT DOCUMENTS 2,239,348 4/1941 Wirtanen et al. ..... 92/5 R X
2,293,167 8/1942 Overbeke ..... 92/13.8 X
3,146,681 9/1964 Sheesley ..... 92/13.6 X
3,213,625 10/1965 Worthen ..... 92/5 X
3,303,755 2/1967 Linker et al. ..... 92/5 R

FOREIGN PATENT DOCUMENTS 2059592 11/1979 Fed. Rep. of Germany ..... 92/5 R
149562 7/1981 German Democratic Rep. ... 92/5 R
192606 11/1982 Japan ..... 92/5 R

*Primary Examiner*—Robert E. Garrett
*Assistant Examiner*—Mark A. Williamson
*Attorney, Agent, or Firm*—McGlew and Tuttle

[57] ABSTRACT

The invention relates to an abutment arrangement for limiting the stroke of a piston and cylinder actuator. The abutment arrangement comprises an integrated detector which may be in the form of a proximity feeler screwed into a guard housing. The abutment arrangement may be furthermore so designed that it prevents twisting of the piston rod in the cylinder.

19 Claims, 5 Drawing Sheets

ABUTMENT ARRANGEMENT AND POSITION DETECTOR FOR A PISTON AND CYLINDER ACTUATOR

BACKGROUND OF THE INVENTION

The invention relates to an adjustable abutment arrangement for limiting the stroke of piston and cylinder actuators.

Piston and cylinder actuators are widely used for many different practical purposes. They have a housing made up of a cylinder tube and the two end caps to shut off the two ends of the tube. Within the tube of the actuator there is a piston making sealing contact with its wall so that it may be displaced axially by the action of fluid under pressure. The piston is connected with a piston rod extending through at least one of the end caps. Normally the piston rod constitutes the power output connection of the piston and cylinder actuator. However the piston rod may also be thought of as a stationary rail on which the housing moves axially; in such a case the housing may be connected with the load for the output of power from the actuator. Piston and cylinder actuators are linear motors whose power output connection moves through a certain linear stroke when the actuator is operated.

It is furthermore usual to limit the stroke by means of an abutment arrangement.

Furthermore piston and cylinder actuators have been designed with detectors, as for example in the form of limit switches, to indicate when the power output means of the actuator has reached a certain position. Such detectors may for example form part of a control circuit by which the supply of fluid under pressure to the piston and cylinder actuator is reversed.

A shortcoming with prior art arrangements is that the signal is generated by the detector independently of the abutment function. There is frequently a desire to produce a signal at exactly that point in time when the detector is touched. Conventional components which only have the function of a fixed abutment or of a signal detector, are inherently not in a position to undertake this function and elaborate adjustment is called for in order to ensure even an approximate synchronism between the impact on the abutment and the generation of a signal which may be further processed for control functions.

SHORT OVERVIEW OF THE INVENTION

One object of the present invention is to remedy the shortcomings of the prior art.

A further aim of the invention is to develop a cheaply produced and readily assembled abutment arrangement that combines the function of a precise and adjustable limitation of the stroke of a piston and cylinder actuator with the precise generation of a signal on reaching the end of a stroke.

In order to achieve these or further aims appearing from the ensuing specification, a detector is integrated in the abutment arrangement.

The present invention provides a unit which combines the function of a fixed abutment with that of a detector producing a signal. This double function leads to significant advantages, and more especially the generation of the signal by the detector exactly at the instant at which abutment takes place is possible. The unit in accordance with the invention is extremely compact and very study, more especially because the abutment member is able to guard the sensitive detector.

Further advantageous forms of the invention will now be outlined and may be gathered from the claims.

The detector may take the form of an electrical, pneumatic, inductive or electronic proximity or other sensor and may be adapted to operate without making physical contact. Such detectors are very reliable and operate with a high degree of precision. However they do have a sensitive sensor surface, which is not to be allowed to come into contact with any other members. Therefore in the interests of operational reliability and of a long working life, the proximity sensor may be accommodated in a strong guard housing, preferably so that the sensor face of the proximity feeler is sunk into the surface of the guard housing. The proximity sensor may be generally cylindrical in form with a screw thread on its outer cylindrical surface so that it may be screwed into a threaded hole in the guard housing. Such a guard housing may at the same time fulfill the function of an abutment and may take the form of a cylindrical guard sleeve with the screw thread thereon to facilitate assembly. Furthermore the double screw thread arrangement makes possible a very precise setting of the proximity feeler, as for example with the use of a differential thread system.

In accordance with a further development of the invention, the guard housing with the form of a cylindrical protective sleeve has a male screw thread on its outer face and is preferably designed to function as an abutment. The abutment arrangement may be designed with setting means for coarse and fine adjustment of the stroke of the piston and cylinder actuator. For coarse setting of the stroke it is possible to have a clamping ring able to be moved on the piston rod axially in the released condition and adapted to be clamped on the said rod. It is furthermore possible to have a threaded ring for fine adjustment of the stroke. Such further development make it possible to combine the ability to precisely generate the signal with the exact setting of the stroke of a piston and cylinder actuator.

A significant disadvantage encountered with known abutment arrangements is that they are arranged eccentrically in relation to the piston rod. As a result at the instant of impact on the abutment, bending or rocking moments are transmitted to the piston rod. Apart from the fact that this impairs the guidance of the piston rod in the cylinder caps and the sealing elements on the piston and the piston rod, such flexure furthermore makes operation less accurate, which is to detect the motion of the piston and cylinder actuator. In order to remedy these disadvantages in the invention, an abutment arrangement is used that is concentric in relation to the piston rod and has a moving abutment on the rod and a concentric abutment on the housing. Owing to its radial symmetry this abutment arrangement puts an end to bending moments on the piston rod so that there is less stress on the material of which the actuator is made and at the time abutment takes place a correct and non-falsified signal will be produced.

The arrangement may further be such that the threaded ring is either screwed to the piston and cylinder actuator to serve as an abutment fixed to the housing or is applied to the clamping ring with a screw connection and serves as a traveling abutment. Both these possible alternatives are characterized by a simple mechanical design and the choice between them will depend on the amount of space available in a given application, it possibly being an advantage to keep the mass moved with the power output means of the actuator as low as possible.

The threaded ring may have means for locking it in given positions of screwing, such means being more especially a setting screw that extends through the threaded ring in a direction normal to its axis. This will preserve the accuracy of the setting of the abutment and prevent the abutment working itself out of the set position.

For special applications the abutment arrangement of the invention may be made even lower in price while at the same time ensuring that the setting of the stroke is not lost even when the piston and cylinder actuator is heavily loaded and the piston is moved at high speeds so that it remains exactly in the set position, the two ends of the tube may be closed by caps with the piston between them connected with a piston rod extending through at least one cap and with the abutment arrangement made up of a fixed abutment applied to the cylinder cooperating with an annular or other counter abutment arranged on the part of the piston rod protruding from the tube. The counter abutment then surrounds the piston rod and is able to be adjusted in the length direction thereof so that it may be set in different positions. The piston rod has a threaded section on a portion thereof extending out of the cylinder or tube while the counter abutment in the form of a threaded ring is mounted on such portion so that it may be screwed to and fro in the length direction of the piston rod. It is then an advantage to have an intermediate ring in the form of a clamping ring to make possible a reduction in the number of components so that the abutment arrangement is then simpler and cheaper in structure. In this respect the direct mounting of the counter abutment on the piston rod with the use of a screw thread produces a positive connection in addition to a non-positive one with the advantage that even in the case of a heavy impact of the two abutments against each other there will be no disturbance due to misalignment of the counter abutment. Once the stroke has been set it will be kept to, for the full working life of the piston and cylinder actuator.

The detector may be carried on the fixed abutment and adapted to be actuated by the counter abutment when same runs against the fixed abutment. On the end face of the threaded ring, having the counter abutment surface, it is possible to have an abutment face that actuates the detector on impact, such surface being parallel to the counter abutment surface, more especially coplanar to it. This design makes it possible for the counter abutment to be made very narrow, since the abutment surface and the actuating surface are placed in a common plane. In this connection it is an advantage if the detector is set back towards the cylinder in relation to the fixed abutment surface. There is then the useful effect that the detector does not have to project past the fixed abutment and take up space to an unnecessary degree.

It is furthermore possible for the threaded ring to be able to be clamped by means of a set screw in relation to the piston rod. In addition to this or as an alternative it may be locked in place by means of a lock nut screwing onto the threaded portion so that same is locked in relation to the piston rod. This secures the threaded ring in any one of its settings so that it is not able to turn in relation to the piston rod and vibrations will not cause the counter abutment to be turned.

The design may be such that the maximum length of the threaded section is equal to the length of the guide head. This ensures that the threaded portion of the piston rod is not moved into the inside of the tube even when the maximum stroke is set and does not damage the seal placed in the cylinder cap.

A further advantage of the abutment arrangement in accordance with the invention is to be seen in the fact that it may be adapted by a very simple design modification to prevent the piston rod from being turned about its axis. In this case a guide rod is provided that is fixed in relation to the housing and which extends in a direction parallel to the piston rod and has a lug or the like formed thereon extending through the abutment driven by the piston rod. The guide rod may more especially be in the form of an extension of a tie rod holding together the caps of the cylinder tube. This is a step towards a modular system with which a conventional piston and cylinder actuator may be equipped to provide a wide range of further developments. It is possible to have a rotation preventing means alone, and also the abutment and detector unit alone, or the said units may be combined with each other. These possibilities exist in connection with a mass produced and standardized cylinder, which then is able to function as a customized cylinder that would normally be very much more elaborate and more expensive, all without any substantial increase in the overall dimensions. Owing to the central arrangement of the abutment it is possible for the length of stroke of a piston rod with antitwist means to be substantially increased.

Further features and advantages of the invention will be seen from the following account of working examples as illustrated in the drawings which are diagrammatic.

LIST OF THE SEVERAL VIEWS OF THE DRAWINGS

DETAILED ACCOUNT OF WORKING EXAMPLES OF THE INVENTION

Figure 1:
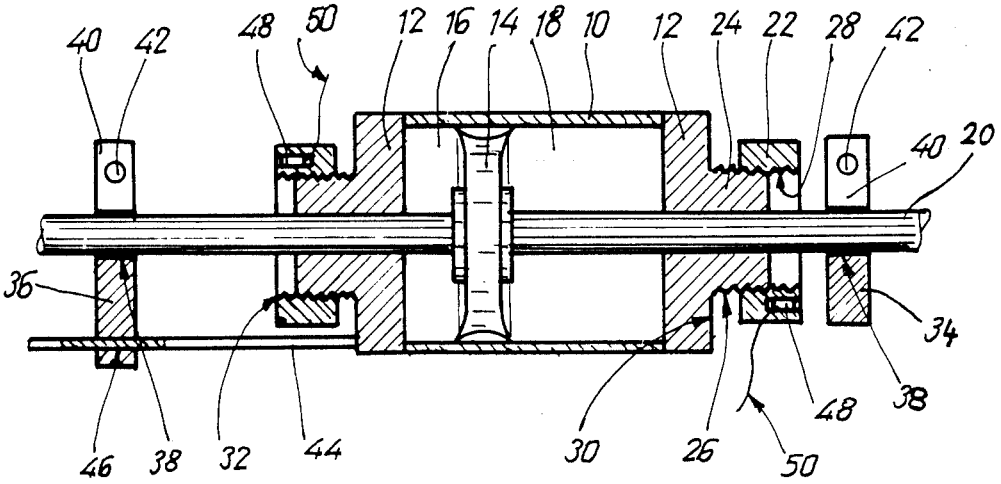
FIG. 1 is a longitudinal section through a piston and cylinder actuator, which is provided with an abutment arrangement in accordance with the invention.

Referring to FIG. 1 the reader will see a diagrammatic view of a piston and cylinder actuator for operation by fluid under pressure, that is to say a hydraulic or pneumatic medium. The housing of the cylinder is composed of a tube 10 and caps 12 closing the two ends of the tube. The tube 10 may be cylindrical with a circular cross section and the caps 12 may have a generally square outline. The caps 12 are joined to the tube 10 by means of tie rods that are not shown in the figure. In the interior of the tube there is a piston 14 sealingly engaging the inner face of the tube. The piston 14 divides the interior of the cylinder housing into two piston spaces 16 and 18 which are able to be supplied with driving fluid by means of connections, which are not shown, so that the piston 14 is caused to perform axially directed strokes two and fro in the cylinder. The piston 14 is connected to a piston rod 20 which extends through the center of the cylinder housing in the axial direction and extends through seals in the two caps 12. The piston rod serves as a power output means and is connected with a load, not illustrated, that is to be driven. On the other hand the piston rod 20 may be stationarily mounted so that the cylinder housing reciprocates on the piston rod 20 and serves as a power output means.

The axial stroke of the actuator is limited by an abutment arrangement, which as will be seen from FIG. 1 comprises two threaded rings 22 with are screwed onto respective caps 12, each having a cylindrical threaded anvil 24 on the side thereof facing away from the tube 10 so that the rings 22 may be screwed on such anvils 24. Each anvil 24 is made with a diameter that is smaller than that of the tube 10 and each anvil extends concentrically to the piston rod 20 and on its outer face has a male thread 26. The threaded rings 22 are cylindrical and have female threads 28 on their inner faces so that they may be screwed onto the male thread 26 of one of the anvils 24. The axial lengths of the threaded anvils 24 and of the threaded rings 22 are more or less equal so that when the threded rings 22 are screwed home as far as they will go they are on the end faces 30 of the caps 12 or spaced slightly from them. The threaded rings 22 may be screwed to a greater or less extent out of this position so that they are proud of the radial end faces 30 of the caps 12 for a larger or smaller distance. In this way they each form an abutment fixed to the housing surrounding the piston rod 20 coaxially with their flat end faces 32, placed normal to the piston rod 20, able to serve as an abutment face. There are respective clamping rings 34 and 36 gripping the piston rod 20 which abut against these abutment faces 32.

The clamping ring 34 to be seen on the right in FIG. 1 has a circular outline. It has an axial center hole 38, which fits over the piston rod 20 and it has a radial slot. FIG. 1 is so drawn that the side 40 of this slot is in sight. It is possible to see that a hole 42 opens through this side face 40, such hole extending in a radial plane so as to be normal to the side face 40 of the slot and running through the material of the ring 34 on both sides of the radial slot. The hole 42 may be a through hole or it may end in the material on one side of the slot, in which it is threaded. A screw, not shown, extends through the hole 42 or is screwed into the one half thereof, and serves to clamp together the parts of the clamping ring 34 so that the ring 34 is clamped onto the piston rod 20 like the jaws of a vise and is locked thereon. When the screw is slackened the clamping ring 34 may be readily shifted along the piston rod 20, whereas when the screw is tightened it will be firmly and immovably locked onto the piston rod 20.

The clamping ring 34 may be fixed on the piston rod 20 in any desired position. This is for coarsely setting the stroke of the piston and cylinder actuator. Fine adjustment is undertaken by screwing the threaded ring 22 along the threaded anvil 24 in the axial direction. In this respect the length of the thread may be quite short, as for example 2 millimeters in order to make possible a precise setting of the stroke.

The mutually abutting surfaces of the threaded ring 22 and of the clamping ring 34 have a generatrix turning about the axis of the piston rod 20. In the illustrated embodiment of the invention the contact face is a flat end or radial face placed concentrically with respect to the piston rod 20. This design of the abutment arrangement ensures that at the instant of impact there are no bending or rocking forces engendered which would act on the piston rod 20. The guiding and sealing means for the piston rod 20 and the piston 14 are therefore not stressed by such forces and the motion of the piston rod will be strictly linear.

FIG. 1 shows an actuator, whose piston rod 20 projects from the housing at both ends through the cylinder caps 12. The left end of the piston rod 20 in FIG. 1 carries a clamping ring 36, which in structure and function is identical to the right hand clamping ring 34. The clamping rings 34 and 36 each have the function of limiting the stroke of the actuator in the one or the other direction. The left hand part of FIG. 1 illustrates additionally the possibility of modifying the abutment arrangement in accordance with the invention to provide the further function of preventing rotation of the piston rod. To do this the clamping ring 36 is provided with a head, lug or the like fitting on a guide rod 44. The guide rod 44 extends in parallelism to the piston rod 20. It may more especially take the form of a modified tie rod and merely be made longer than the normal ties or tie bolts used for clamping the cylinder caps 12 on the tube. The guide rods 44 extends with a running fit through a hole 46 or other form of opening in the clamping ring 36, so that it is connected with the clamping ring 36 eccentrically. The latter may be slipped along the piston 20 and the guide rod 44 at the same time after the set screw has been loosened in order to coarsely set the piston stroke. For fine adjustment of the stroke the threaded ring 22 is again used which cooperates with the clamping ring 36.

In the abutment arrangement described there are integrated detectors 48, which produce a processable signal as soon as the respective abutment position is reached, for control purposes. The signal detectors may be more especially electrical, inductive, electronic or pneumatic proximity feelers. Leads for the power supply to the detectors 48 and for conduction of the signals produced thereby are referenced 50. The detectors 48 are received in holes in the threaded rings 22, which are open towards the end face 32 at which abutment takes place. The detectors 48 may be sunk in these holes. They respond accurately when the clamping rings 34 and 36 abut the threaded rings 22, that is to say when the piston and cylinder actuator reaches the end of its stroke. The signal produced may for example be used for reversing the flow of driving liquid or for other control purposes.

Figure 2:
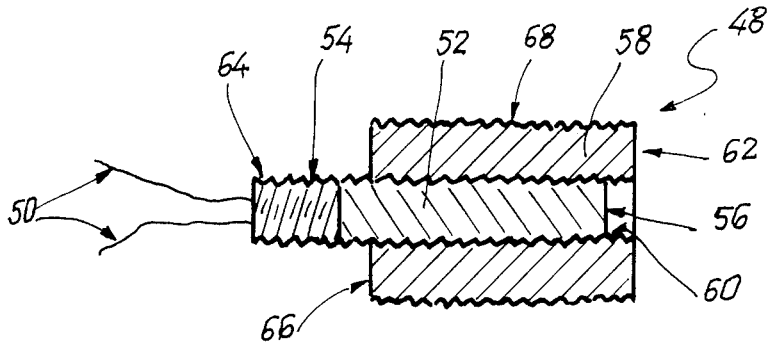
FIG. 2 is a longitudinal section through a detector which is built into a guard housing.

FIG. 2 shows a preferred form of the detector 48. In this case there is a cylindrical, pin-like proximity feeler 52, which has an external thread 54. Electrical proximity feelers in this form are commercially available. One of its end faces is adapted to serve as the detector or sensor surface 56, while on its other end faces there are lead terminals 50 for the supply of power and for output signals. The proximity feeler 52 may be one operating on the principle of inductive damping. In this case a stray electromagnetic field is emitted at the sensor surface 56, which is damped when a metallic object is placed in it. This damping is discriminated and used in a trigger stage to produce a signal. However it is equally possible to use magnetic proximity feeler 52, that react to the presence of ferromagnetic materials placed in the proximity of the sensor surface 56. It is furthermore possible to utilize a pneumatic proximity feeler, which directs an air jet from the sensor surface 56 and which has means for detecting the pressure increase produced when an object is moved up to the surface 56.

All these feelers have the feature in common that the sensor surface 56 is relatively sensitive. Therefore direct contact with an approaching member, as for example one in the form of an abutment should be avoided at all costs. The invention therefore provides a guard housing 58 for accommodating the proximity feeler 52. The guard or protective housing 58 has hole 60 or recess of the like in which the proximity feeler 52 is able to so fit that its sensor surface 56 may take up a position behind the surface 62 of the guard housing 58. Any objects moving along a given path which are detected by the proximity sensor 52, as for example an abutment attached to the output means of the cylinder actuator is therefore not able to strike the sensor surface 56 directly but will rather act on the surface 62 of the guard housing 58, same then being able to fulfill the function of a counter abutment.

In the event of the proximity feeler 52 being furnished with an external thread 54 the hole 60 of the guard housing 58 will be provided with a hole having an internal thread therein, into which the external or male thread of the proximity feeler 52 will fit. In this way the proximity feeler may be screwed into the guard or protective housing 58; its sensor face 56 may then be simply adjusted to be at the desired level in relation to the surface 62 of the guard housing 62 and there is the advantage that it is then possible to secure the proximity feeler 52 at a precise position on assembly. In this respect the other end 64, on which the connection leads 50 are preferably attached as well, may be left protruding from the guard housing 58 so that a lock nut, not shown, may be screwed onto the projecting threaded section. This nut may more especially be so arranged that it abuts against the end face 66 of the guard housing 58.

The guard housing 58 as in FIG. 2 has the form of a stout cylindrical sleeve, made for example of steel. On the outer face of the sleeve an external screw thread 68 is provided by means of which the sleeve may be screwed into suitable assembly holes. This form of assembly is simple and may be adapted for a large number of specific applications. Owing to the twin arrangement of threaded holes on the sleeve—i.e. the internal thread in the hole 60 and the external thread 68—a very exact adjustment of the proximity feeler 52 becomes possible, as for example one utilizing a differential screw action. The sleeve forms a strong guard housing 58 around the entire proximity feeler 52, for which reason it may also be termed an armored sleeve.

It is obviously possible for the guard housing to have a form other than that of a cylinder (i.e. with a round cross section) and in fact in embodiments of the invention to be explained below (see FIGS. 8 and 9) It has a block-like or parallelepiped form and is attached by means engaging one of its flat outer faces.

The guard sleeve and a proximity feeler 52 screwed into it may be used in the sensor unit in the abutment arrangement of FIG. 1. For this purpose the guard sleeve is screwed into suitable threaded holes in the threaded rings 22, which open on their end face 32 facing the clamping rings 34 and 36. However it is also possible for the proximity feelers 52 to be placed directly in these threaded holes. The threaded rings 22 then assume the function of a guard housing for the proximity feelers, whose sensor face 56 is sunk to be within the level of the end face 32.

Figure 3:
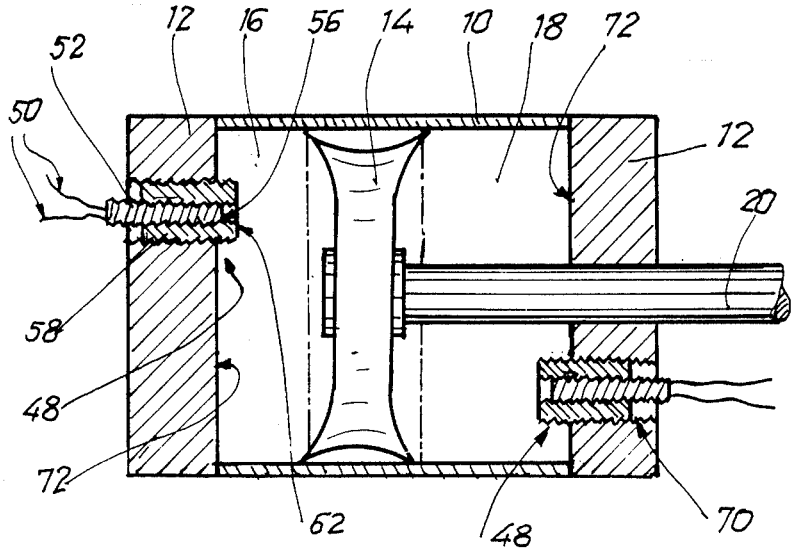
FIG. 3 is a longitudinal section through a further piston and cylinder actuator as an example of the application of the detector.

FIG. 3 shows a further working example of the sensor unit of the present invention. The figure shows a pressure fluid driven piston and cylinder actuator with a cylinder tube 10 and two end caps 12, in the case of which the piston rod 20 only extends through the one cap 12 with a suitable rod seal therein. The two end caps each have a threaded hole 70, which at least in the case of the cap 12, which has the piston rod running through same, is placed eccentrically. An armor or guard sleeve is placed in each of the threaded holes 70 and such sleeve contains a proximity feeler 52 of the described design. The sensor faces 56 of the proximity feelers 52 are turned towards the interior of the cylinder housing and the piston 14. The guard sleeve serves as an abutment for the piston. It is so screwed into the cap 12 that it projects to a certain extent past the inner face 72 of the cap 12, such amount of projection being able to be adjusted to suit requirement. The surface 62, which is at a small distance from the sensor surface 56, serves as an abutment face for the piston 14. The impact of the piston 14 on this face is detected by the proximity feeler 52 in a highly accurate manner. By screwing the guard sleeves in the cylinder end caps 12 the piston stroke may be accurately set in both directions.

To make FIG. 3 mre straightforward the sealing means and the pressure fluid connectins have been omitted. It will however be understood that the sensor units are sealed in some suitable way if the threaded holes 70 are provided in the caps 12 so as to extend right through them. It is furthermore possible to make the threaded holes in the form of blind holes (not shown).

FIGS. 4 through 6 and FIG. 8 show two further working examples of the invention in the form of an abutment arrangement placed externally of the cylinder housing. As has been previously illustrated in FIG. 1 the external abutments are more especially used in the case of an actuator with the piston rod 20 protruding out through both ends of the cylinder and running through both of the caps 12. In the case of a cylinder with the piston rod 20 extending out through one end of the cylinder housing it possible to have internal abutments for defining the two ends of the piston stroke. The connection arrangements to be seen in FIGS. 4 through 8 are best placed at both ends of a piston rod 20, which passes through the cylinder housing of a piston and cylinder actuator, although they may also be used in the case of a piston and cylinder actuator whose piston rod extends from only one end of the cylinder.

Figure 4:
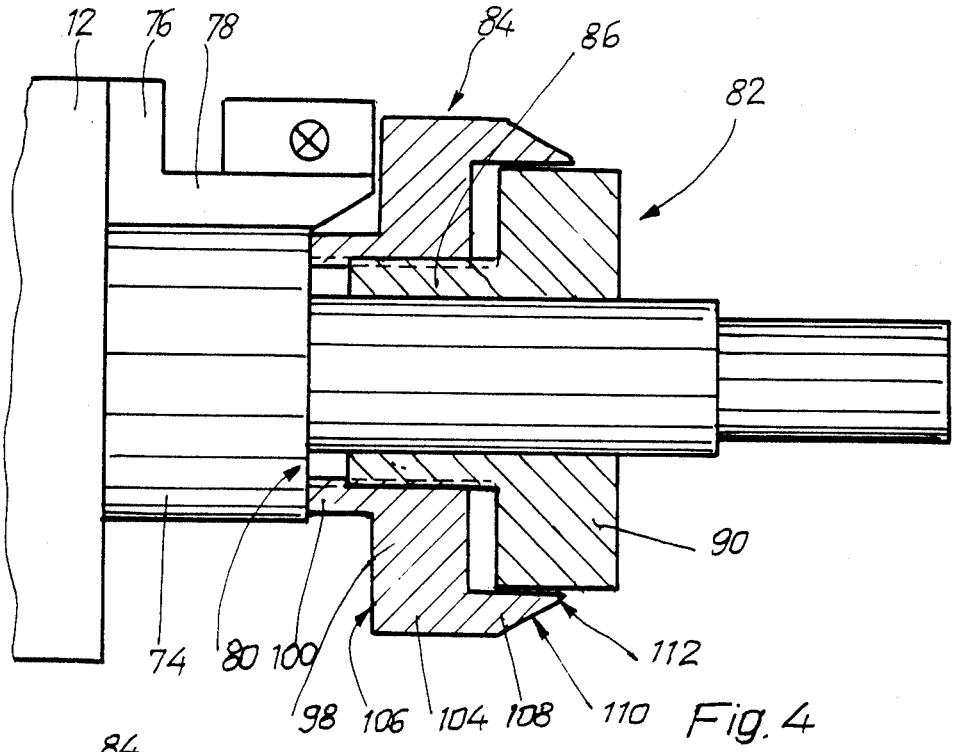
FIG. 4 is a more detailed view, partly in longitudinal section of a piston and cylinder actuator which comprises a clamping ring mounted on the piston rod and a threaded ring screwed onto the clamping ring.
Figure 8:
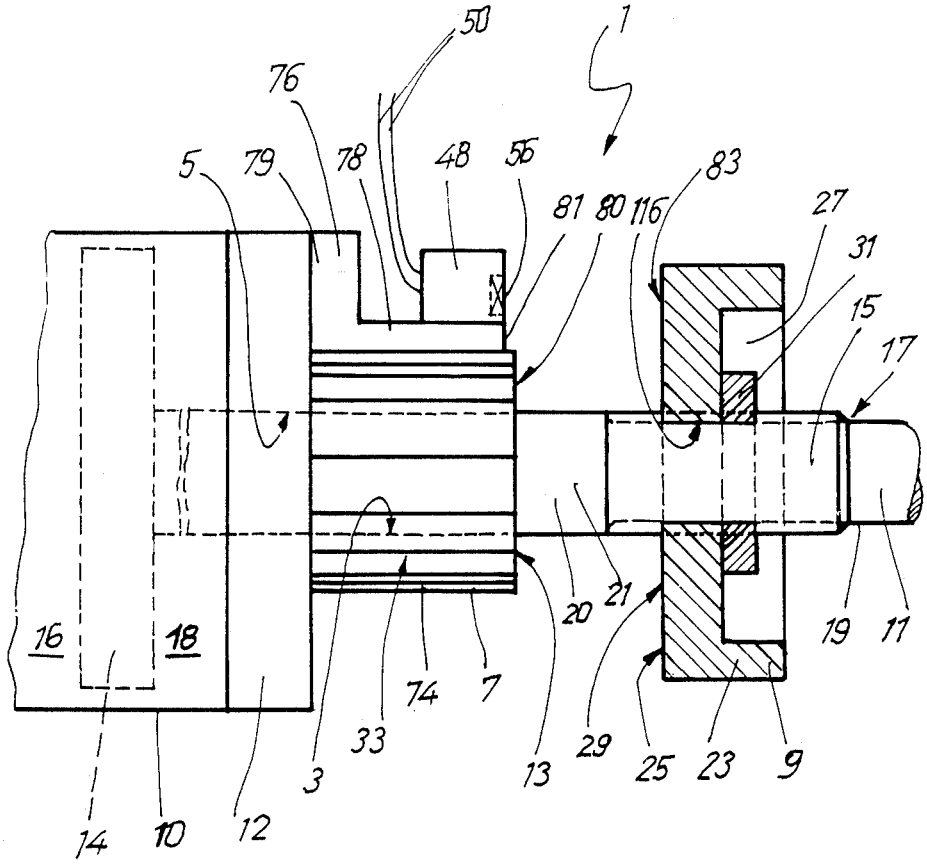
FIGS. 8 and 9 show further working examples of the abutment arrangement.

It will be seen from FIGS. 4 and 8 that the one of the end caps 12 has the head 74 or anvil extending in the axial direction. The anvil 74 is arranged so as to be concentric with the cover 12. It may have a rectangular or, in as FIGS. 4 and 8, a circular form and its cross section is smaller than that of the cap 12. Over the anvil 74 an L section 76 is fixed to the cap 12, the longer flange 78 of the section carrying a detector 48 that is only diagrammatically shown and which may comprise a proximity feeler 52 and be designed as in FIG. 2.

The anvil 74 and also the cylinder cap 12 have the piston rod 20 extending centrally through them (see the through holes 3 and 5 shown in FIG. 8) so that the end face 80 of the anvil 74 surrounds the piston rod 20 concentrically. The end face 80, which extends normally in relation to the piston rod 20, forms an abutment surface fixed in relation to the housing and against which an adjustable abutment on the piston rod runs.

In the following account, which is based solely on the FIGS. 4 through 6, it will be seen that the longer flange 78 of the L section 76 extends past the front end face 80 of the anvil 74 and that the abutment consists of a bell-like clamping ring 82 and a threaded ring 84 screwed thereonto. In this respect the clamping ring 82 has an axial threaded sleeve 86 with an external screw thread 88 and a flange 90 formed on the threaded sleeve 86. The flange 90 has a larger external diameter than the sleeve 86. The threaded sleeve 86 and the flange 90 have a coaxial bore 92 passing through them from end to end. The presence of this axial bore makes it possible to fit the clamping ring 82 on the piston rod 20 with play. The flange 90 is radially slotted, such slot merging with the axial bore 92. FIG. 6 is so conceived that the eye of the reader is directed towards one side 94 of the slot. A further hole 96 extends at a right angle to this side face 94 and extends through the material of the flange 90 on one side of the slot as a plain hole and extends through the material on the other side of the slot as a threaded hole. In this hole 96 a set screw, not shown, may be screwed in order to tighten the flange 90 on the piston rod 20 by closing the slot. When the clamping ring 82 is so clamped onto the piston rod 20 the deformation of the ring 82 takes place essentially at the flange 90 whereas the threaded sleeve is hardly deformed at all.

The clamping ring 82 is so secured on the piston rod 20 that the threaded sleeve 86 is pointing towards the cylinder housing. The threaded ring 84 is screwed onto the threaded sleeve 86 and serves as the abutment and runs up against the end face 80 of the anvil 74.

The threaded ring 84 has a sleeve member 98, whose axial length is greater than that of the threaded sleeve 86. The external diameter of the sleeve member 98 is reduced in a step on the side thereof facing the cylinder housing. An externally cylindrical part 100 with a smaller diameter takes up a position within the flange 78 so that its end face 102 abuts the anvil 74. On the other hand a flange-like part 104 with a larger diameter than the sleeve member 98 extends radially both over the sleeve 86 and also over the flange 90 of the clamping ring 82. This part 104 has a flat end face 106 extending in a direction normal to the piston rod 20 and the proximity of this end face 106 is detected by the detector 48. Furthermore on the side, facing away from the cylindrical housing, of the part 104 there is a skirt 108 extending over and encompassing the flange 90 of the clamping ring 82. The end of the skirt 108 is chamfered at 110 and forms a datum edge 112, that is placed directly over the flange 90. There is a scale, not illustrated, on the outer face of the flange 90. The datum or marker edge 112 is used to observe how far the threaded ring 84 has been screwed forwards on the clamping ring 82 in the axial direction with a micrometer function.

Figure 5:
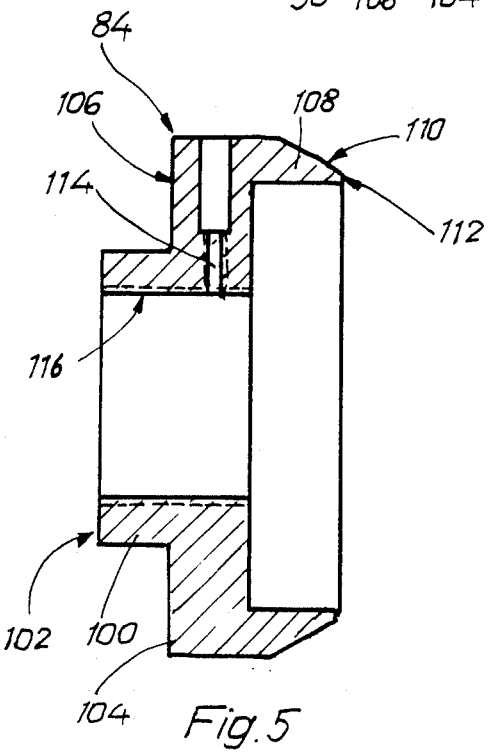
FIG. 5 is a longitudinal section taken through the threaded ring.
Figure 6:
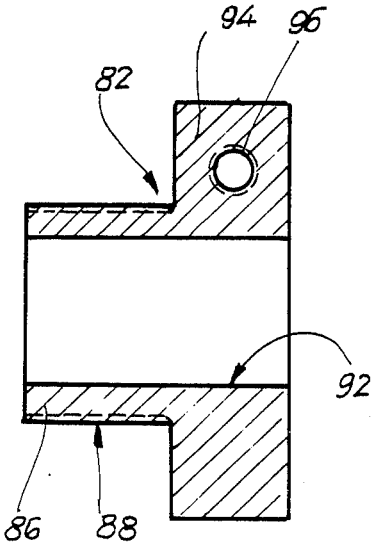
FIG. 6 is a longitudinal section through the clamping ring.

In FIG. 5 it will be seen that the threaded ring 84 may be arrested in a given position of screwing on the clamping ring 82. For this purpose the flange-like part 104 has a threaded hole 114 therein, which extends in a direction normal to the longitudinal axis of the threaded ring 84 and intersects the interval thread 116 of the threaded ring 84. The threaded hole 114 receives a set screw, not illustrated, which acts on the threaded sleeve of the clamping ring 82 so as to fix the threaded ring 84 in place. There is therefore no chance at all of the set position being lost during operation by the parts working loose of their own accord.

In the case of the design of FIGS. 4 to 6 the procedure is again to loosen and tighten the clamping ring 82 firstly in order to arrive at a coarse setting of the abutment arrangement. Then the threaded micrometer ring 84 is screwed backwards or forwards as may be necessary in order to produce a fine adjustment that is then fixed by tightening the set screw. The threaded ring 84 forms an abutment member surrounding the piston rod 20 coaxially, which also runs onto the anvil 74 placed around the piston rod and fixed to the housing in order to act as a counter abutment. The approach of such part is precisely detected by the detector 48.

In the working example of FIG. 8 the anvil 74 forms a stationary abutment 7 fixed to the housing. An adjustable counter abutment which is secured to the part 11 of the piston rod 20 protruding from the cylinder so as to be moved with the piston rod 20 is able to run up against this fixed abutment 7. In this respect the end face 80 of the anvil 74 forms the fixed abutment surface 13 of the fixed abutment 7, which faces the counter abutment 9. The latter is mounted directly on the piston rod 20 and is screwed thereto so that it may be adjusted in position. To make this possible the piston rod 20 is provided with a threaded portion 15 on its part 11 in order to carry the counter abutment 9 and whose length is preferably so selected that at a maximum setting of the depth of entry of the piston rod 20 into the cylinder 10 it only extends approximately as far as the transition between the anvil 74 and the cylinder cap 12. The length of the threaded portion 15 is therefore at the most only equal to the length of the anvil 74, this being so for a simple reason: In the cylinder cap 12 there is a sealing ring (not shown) to produce a seal between the cylinder cap 12 and the piston rod and which surrounds and makes contact with the piston rod 20. If now the threaded portion were to run into this seal structure it would be possible for the crests of the threads thereon to damage the sealing ring. This is prevented by the described design of the threaded portion 15. This naturally limits the range of adjustment of the counter abutment 9, something that is however of subordinate importance. The piston and cylinder arrangement as described with reference to FIG. 8 is more especially intended for applications in which a fine re-adjustment of the set stroke is necessary now and again.

At its part extending out the cylinder and at the threaded portion 15 the piston rod 20 has steps (at 17). The step 17 separates a part of the piston rod with a smaller diameter 19 from a part with a larger diameter 21. The latter part is adjacent to the cylinder and carries the threaded portion 15, whose threaded anvil is formed by the step 17. This measure ensures that the counter abutment 9 may be readily screwed onto the piston rod 20 and firstly it is possible for the counter abutment 9 to be slipped over the part 19 with the smaller diameter as far as the step 17, from which position its may be screwed onto the threaded portion 15 of the part 21 with a larger diameter. Preferably the difference in diameter is approximately to the two the height of the flank of the thread on the portion 15.

The counter abutment 9 is of annular form and constitutes the threaded ring 23, which has a central, coaxial threaded hole 116. This has the same diameter as the threaded portion 15 so that the threaded ring 23 may be screwed backwards and forwards in the length direction of the piston rod 20 on the threaded portion 15. The threaded ring 23 is furthermore designed in the form of a bell or pot so that it has a U-like longitudinal section. The floor 25 of the bell-like ring is flat and extends transversely in relation to the piston rod 20, it being contained in a plane which is at a right angle to the said piston rod 20.

The floor 25 of the threaded ring 23 is on the side of the ring 23 nearer the fixed abutment 7 and the recess 27 in the bell-like threaded ring 23 is directed away from the fixed abutment 7. The floor face, turned towards the fixed abutment 13, of the floor 25 and of the threaded ring 23 form a counter abutment surface 29, which abut the fixed abutment on the abutment face 13 of the counter abutment when the later is moved into engagement.

By screwing the threaded ring 23 backwards and forwards on the threaded portion 15 it is possible to set the depth of penetration of the piston rod 20 into the cylinder 10. In this respect the threaded ring 23 and the counter abutment 9, respectively, may be arrested at any desired setting on the piston rod 20, this being preferably being done by a clamping means. For this purpose the abutment arrangement 1 possesses a lock nut 31 screwed on the threaded portion 15. This nut is arranged on the side, remote from the cylinder, of the threaded ring 23 and is received in its recess 27 in the bell. By tightening the lock nut 31 onto the threaded ring 23 it is possible to set the latter in any desired position in relation to the piston rod 20 so that it may not be turned in relation thereto.

It will be seen that both the fixed abutment face 13 and also the counter abutment face 29 each have the form of an annular face which extends coaxially around the piston rod 20, the two faces being designed so that they are exactly parallel to each other. This offers the advantage that when the counter abutment 9 runs up against the fixed abutment 7 no asymmetrical forces will be transmitted onto the piston rod 20, which would otherwise cause it to bend. In fact there is a symmetrical transmission of force onto the piston rod 20 and the same its only loaded with a tension or compressive force so that there is practically no chance of damage thereto.

As has been described the abutment arrangement in accordance with figure 8 also has an integrated detector 48 which produces a signal for later processing when a respective position of abutment is reached between the fixed and counter abutments. This detector 48 is preferably designed as in FIGS. 1 and 2 so that it may perform the functions mentioned in connection with these figures.

As may be seen from FIG. 8 this detector 48 is arranged on the fixed abutment 7 and secured to the L-section 76 as described. The longer flange 78 extends in parallelism to the piston rod and rests on the outer face 33 of the anvil 74 or forms a single structure therewith. The short flange 79 rests on the end face of the cylinder cap 12 and is preferably screwed to the cylinder cap. The longer flange 78 comes to any end short of the fixed abutment face 13, that is to say its end face 81 is set back in relation to the fixed abutment face 13 towards the cylinder 10 and carries the detector 48 that is only indicated diagrammatically in the drawing. It is secured at the end face 81 and has a sensor face 56 turned towards the counter abutment 9. The sensor face 56 is in a plane that is transverse in relation to the piston rod 20, said plane being spaced a small distance from the plane containing the fixed abutment surface 13 and parallel thereto.

The detector 48 cooperates with the counter abutment 9 like the fixed abutment. For this purpose on the end face (floor 25) turned towards the detector 48 of the counter abutment 9 has an actuating face 83 formed thereon, to which the detector 48 responds on approach of the counter abutment 9 and produces a suitable signal. The actuating face 83 is made parallel to the counter abutment face 29 and is preferably coplanar with respect thereto. The two faces therefore merge smoothly with each other. This allows simple fixation of the counter abutment 9 in a single manufacturing operation, as for example by turning the threaded ring 23 on a lathe so as to be plane. The two surfaces may therefore be formed at the same time.

An account will now be given of the manner of operation of the arrangement:

If the piston space 18 in the cylinder 10 adjacent to the anvil 74 is put under pressure, the piston 14 will be moved to the left in terms of FIG. 1 and the piston rod 20 will be displaced. At the same time the counter abutment 9 will be moved as well and the motion will last until the counter abutment face 29 of the counter abutment 9 strikes the fixed abutment face 13 of the fixed abutment 7. At the same time as this act of abutment there will be a contact-free actuation of the detector 48 by the actuating face 83 and the detector will produce a signal which, for instance, will reverse the direction of motion of the piston by causing the supply of driving fluid into the second piston space 16. Since the actuating surface and the counter abutment face of the counter abutment 9 are coplanar there is no difficulty in timing the control signal from the detector 48 to be exactly simultaneous with the time of impact of the counter abutment on the fixed abutment. The distance between the fixed abutment face 13 and the set back detector 48 as measured in the direction of the length of the piston rod is exactly equal to the switching distance that is selected in accordance with the sensitivity of the detector and may be varied by changing the position of the sensor face 56 (see FIG. 2).

It will be clear that the radius of the threaded ring 23 is equal to at least the distance of the detector 48 from the longitudinal axis of the piston rod 20. Accordingly a very high degree of measuring accuracy is attained, since the actuating face 83 is placed to be opposite the detector 48 and in precise axial alignment therewith. At the same time the annular form of the actuating face 83 ensures that even if the piston rod 20 is twisted in relation to the cylinder 10 the actuating face will always be arranged in the best possible position in relation to the detector 48.

It will furthermore be clear that the detector may be placed in the fixed abutment 7 so as to be sunk into the same for instance. In this case the outer diameter of the counter abutment may be reduced and the piston and cylinder will then appear to be more compact. Other geometrical designs, including that of the counter abutment, are conceivable. The counter abutment does not necessarily have to have the form described. It is however in any case important that the counter abutment 9 be mounted directly on the piston rod so that it may be screwed backwards and forwards along it. The counter abutment is therefore practically positively locked in relation to the same and even if there is a heavy impact on the fixed abutment there will be no chance of sliding and misaligment. The fixing the counter abutment may be aided by the lock nut 31, which in addition constitutes a non-positive or friction connection with the piston rod.

Figure 7:
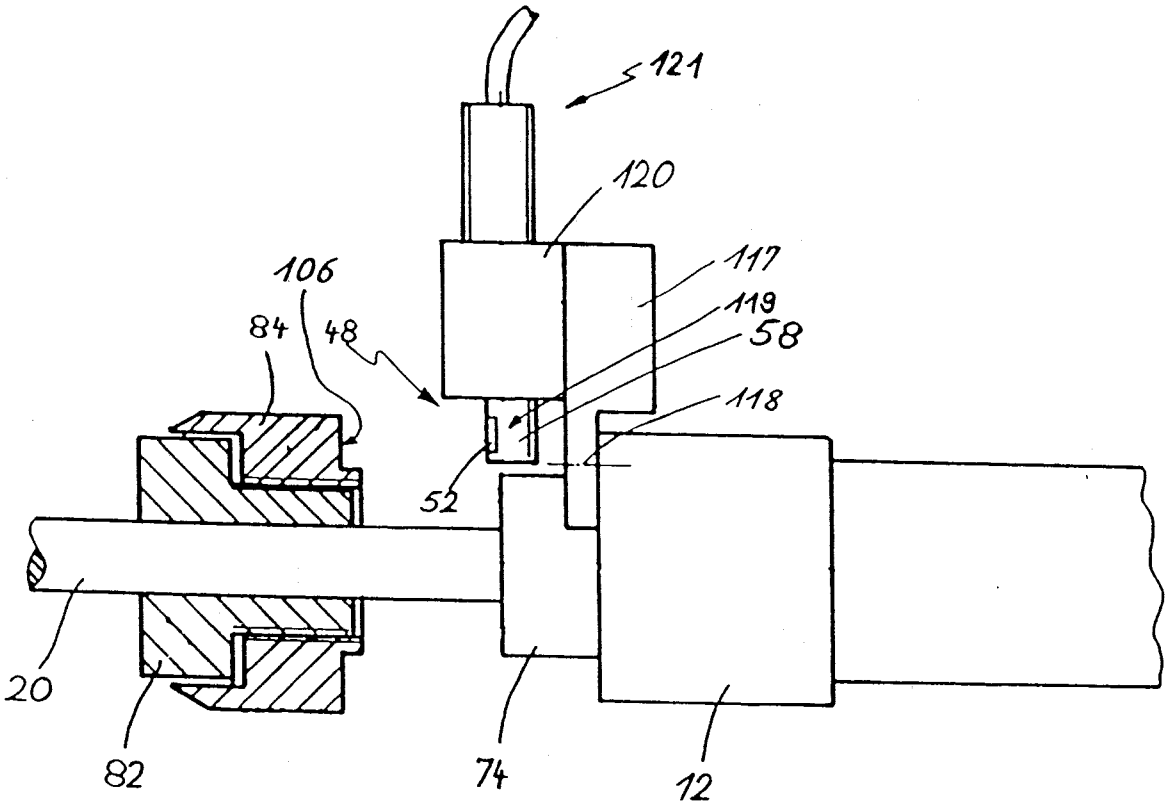
FIG. 7 shows a further embodiment of the invention in the form of an abutment arrangement.

Referring to FIG. 7 the reader will see a further abutment arrangement for a piston and cylinder actuator designed on the lines of the abutment arrangement in FIG. 4. It will again be seen that there is the cylinder cap 12, the anvil 74 and the piston rod 20, on which the clamping ring 82 carrying the threaded ring 84 is mounted. Over the anvil 74 a holder 117 is fixed on the cap 12, as for example by screws at 118. On its end face opposite the anvil 74 the holder 117 has a circular recess which generally corresponds to the form of the circumference of the anvil 74, as for instance in the form of a cylinder. The holder 17 itself projects generally radially from the anvil 74.

At the front side, facing the rings 82 and 84, of the holder 117 the detector 48 is placed which has a proximity feeler 52 facing the threaded or clamping ring 84 and 82. The detector 48 may again be in the form of an electrical pneumatic, inductive or electronic detector and cooperates with the end face 106 of the threaded ring 84 without contacting it.

The guard housing 58 for the proximity feel 52 is cylindrical in design and is placed radially in relation to the piston rod 20. The proximity feeler 52 is embedded so as to be under the outer face 119 and it is more especially possible to ensure that the proximity feeler 52 is at a lower level than the outer face 119 of the guard housing 58. To ensure functional reliability of the detector 48 the proximity feeler 52 is at about the same radial distance from the piston rod 20 as the acting corresponding end face 106 of the threaded ring 84.

Reference 120 denotes a holding housing which is mounted on the holder 117 and carries the guard housing 58 and an electrical or pneumatic connector 121 or terminal.

Figure 9:
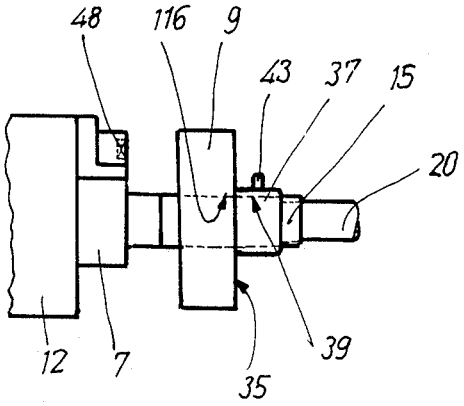

FIG. 9 diagrammatically shows a further working example of the piston and cylinder actuator, which has generally the same components as the arrangement of FIG. 8, with the cylinder cap 12, the fixed abutment 7, the detector 48, the piston rod 20 and the counter abutment 9 in the form of the threaded ring. Unlike the embodiment of FIG. 1, the counter abutment 9 has the form of a ring with a square or other rectangular form, on whose end face 35 directed away from the cylinder 12 there is an integral fixing head 37 in the form of a hollow cylindrical sleeve with a threaded hole 39 through it coaxial to the threaded hole 116. The two threaded holes have the same diameter. The counter abutment 9 is thus able to be screwed with its fixing head 37 on the threaded portion 15, that is preferably somewhat longer, of the piston rod 20. There is a radial threaded hole, not shown, in the fixing head 37 to accept a set screw 43 able to be screwed onto the threaded portion 15. This set screw 53 prevents the counter abutment 9 from turning on the piston rod 20.

A further embodiment, now shown, has a threaded radial hole directly in the counter abutment 9 to accept a set screw with which the counter abutment 9 may be turned in relation to the piston rod 20 for clamping.

I claim:

1. An adjustable abutment arrangement for a piston and cylinder actuator, comprising a detector integrated in said arrangement, said actuator having a housing with a tube, a piston movable in said tube and a piston rod extending through at least one wall of said actuator housing, affixed abutment connected to said actuator housing having an abutment surface, said detector being affixed to said affixed abutment, said affixed abutment having an end face for blocking movement of said piston to define a stroke of said piston, and adjustment means for adjusting an engagement position between said piston and said affixed abutment for adjusting the stroke, said detector being a proximity feeler selected from the group comprising an electrical detector, an inducive detector, and an electronic detector, comprising a sturdy guard housing in which said proximity feeler is accommodated and defining said affixed abutment, said proximity feeler having a generally cylindrical form and on an external face has a screw thread to screw into a female thread in said guard housing for fitting said proximity feeler thereinto.

2. The abutment arrangement as claimed in claim 1 wherein said guard housing has the form of cylindrical armored member which has a male thread on an outer face thereof and is adapted to perform an abutment function.

3. An adjustable abutment arrangement for a piston and cylinder actuator, comprising a detector integrated in said arrangement, said actuator having a housing with a tube, a piston movable in said tube and a piston rod extending through at least one wall of said actuator housing, and adjustment means for separate coarse and fine setting of the stroke of the piston and cylinder actuator.

4. The abutment arrangement as claimed in claim 3 comprising a clamping ring able to be loosened to slide along the rod of the actuator and to be clamped thereon for coarse adjustment of the stroke.

5. The abutment arrangement as claimed in claim 4 comprising a threaded ring for fine adjustment.

6. The abutment arrangement as claimed in claim 4 comprising a threaded ring screwed onto said clamping ring and adapted to move therewith.

7. An adjustable abutment arrangement for a piston and cylinder actuator, comprising a detector integrated in said arrangement, said actuator having a housing with a tube, a piston movable in said tube and a piston rod extending through at least one wall of said actuator housing, piston and cylinder actuator having caps shutting off two ends of the tube, said rod extending through at least one of said caps, said abutment arrangement comprising a fixed abutment and a counter abutment for cooperation therewith and placed on a part of said rod extending out of said tube, means for fixing said counter abutment on said rod after being moved along same, said counter abutment being mounted directly on said rod and surrounding same directly, said rod having a portion thereof outside said tube, said portion being provided with a screw thread on which the counter abutment being in the form of a threaded ring, said detector being set back from said fixed abutment face towards said cylinder.

8. The abutment arrangement as claimed in claim 7 comprising an anvil arranged on the said cap with the rod extending therethrough, said anvil projecting from such cap towards said threaded ring and surrounding said piston rod coaxially, said threaded ring having a counter abutment face turned towards said anvil and adapted to abut an end face of said anvil for limiting the stroke of said actuator.

9. The abutment arrangement as claimed in claim 8 wherein said detector is carried by said fixed abutment and is adapted to be actuated by the counter abutment when same contacts said fixed abutment, and an end face with the counter abutment face of the threaded ring has an actuating face for actuating the detector when same engages said fixed abutment, said actuating face being parallel to said counter abutment.

10. The abutment arrangement as claimed in claim 9 wherein said actuating face is coplanar with respect to said counter abutment face.

11. The abutment arrangement as claimed in claim 8 comprising a set screw for fixing the threaded ring in relation to the rod.

12. The abutment arrangement as claimed in claim 8 wherein the threaded portion has a length which is at the most equal to the length of said anvil.

13. The abutment arrangement as claimed in claim 7 comprising a lock nut adapted to screw onto the threaded portion to fix said threaded ring in relation to said rod.

14. An adjustable abutment arrangement for a piston and cylinder actuator, comprising a detector integrated in said arrangement, said actuator having a housing with a tube, a piston movable in said tube and a piston rod extending through at least one wall of said actuator housing, said detector being a proximity feeler selected from the group comprising an electrical detector, an inductive detector and an electronic detector, a sturdy guard housing in which said proximity feeler is accommodated, said proximity feeler having a sensor surface placed behind the plane of an abutment surface of said guard housing which is meant for engagement by a part movable with said piston.

15. An adjustable abutment arrangement for a piston and cylinder actuator, comprising a detector integrated in said arrangement, said actuator having a housing with a tube, a piston movable in said tube and a piston rod extending through at least one wall of said actuator housing, affixed abutment connected to said actuator housing having an abutment surface, said detector being fixed to said affixed abutment, said affixed abutment having an end face for blocking movement of said piston to define a stroke of said piston, and adjustment means for adjusting an engagement position between said piston and said affixed abutment for adjusting the stroke, said actuator housing having an end cap, said piston rod extending through said end cap, said fixed abutment comprising a threaded guard threaded into said cap, said detector comprising a feeler threaded into said threaded guard, said threaded guard carrying said end face of said affixed abutment, said feeler having a sensing face recess with regard to said end face of said threaded guard.

16. An adjustable abutment arrangement for a piston and cylinder actuator, comprising a detector integrated in said arrangement, said actuator having a housing with a tube, a piston movable in said tube and a piston rod extending through at least one wall of said actuator housing, a fixed abutment connected to said actuator housing having an abutment surface, said detector being fixed to said fixed abutment, said fixed abutment having an end face for blocking movement of said piston to define a stroke of said piston, and adjustment means for adjusting an engagement position between said piston and said fixed abutment for adjusting the stroke, a portion of said piston rod extends out of said actuator housing, a counter abutment fixed at an adjustable location on said portion of said piston rod which is outside of said actuator housing, said counter abutment having an end face engageable against the end face of said fixed abutment for defining the stroke of said piston, said counter abutment having a surface for movement adjacent said detector at the end of said piston stroke for activating said detector at the same time that said end faces engage each other.

17. The abutment arrangement as claimed in claim 16 comprising a threaded ring screwed on the housing of the piston and cylinder actuator to serve as said fixed abutment attached to the housing.

18. The abutment arrangement as claimed in claim 17 wherein said threaded ring is adapted to be arrested in set positions of screwing.

19. The abutment arrangement as claimed in claim 18 comprising a set screw extending through said threaded ring radially.

* * * * *